US005934922A

United States Patent [19]

Chiotis

[11] Patent Number: 5,934,922

[45] Date of Patent: Aug. 10, 1999

[54] SEALING MEMBER

[75] Inventor: Achilles Chiotis, Mountain View, Calif.

[73] Assignee: Raychem Corporation, Menlo Park, Calif.

[21] Appl. No.: 08/798,401

[22] Filed: Feb. 7, 1997

[51] Int. Cl.[6] ..... H01R 13/52

[52] U.S. Cl. ..... 439/204; 439/587

[58] Field of Search ..... 439/204, 936, 439/587, 589

[56] References Cited

U.S. PATENT DOCUMENTS

| | | | |
|---|---|---|---|
| 4,875,870 | 10/1989 | Hardy et al. | 439/204 |
| 5,529,508 | 6/1996 | Chiotis et al. | 439/204 |
| 5,588,856 | 12/1996 | Collins et al. | 439/204 |

FOREIGN PATENT DOCUMENTS 0 299 797 A2 1/1989 European Pat. Off. .

0 731 531 A2 9/1996 European Pat. Off. .

*Primary Examiner*—Neil Abrams

*Attorney, Agent, or Firm*—Herbert G. Burkard; Sheri M. Novack

[57] ABSTRACT

A self supporting sealing member (2) having a layer of sealant (4) positioned longitudinally between two constraining layers (6, 8). The lateral dimensions of the sealing member are designed to fit within a hollow member. A perforation (12) is formed or cut in the sealing member to define a removable section of sealant (14). A substrate or wire (S) can be inserted and withdrawn an unlimited number of times, without tearing or otherwise damaging the sealing material. Once the substrate or wire is inserted, force is applied to seal the device. The sealing member of the present invention also provides for contact serviceability and insertion forces lower than in prior art devices.

15 Claims, 1 Drawing Sheet

SEALING MEMBER

FIELD OF THE INVENTION

The present invention relates to a sealing member and an assembly for sealing a hollow member.

BACKGROUND OF THE INVENTION

Known prior art methods of sealing wires and/or terminals include the use of grommets or other similar compression seals, and the use of heat shrinkable sealing sleeves. Other prior art methods use articles containing grease. However, greases lack any type of structural network, and this results in the greases generally being viscous and flowing when subjected to temperature cycling, thereby providing a relatively unstable means for protecting the terminals and/or wires. Epoxies and other adhesives have also been used, but they are also disadvantageous in that reentry is difficult.

Gel grommets are an effective method of sealing close center-to-center spaced connectors. A single sealing member may be employed in an application for which the number of connections is not known prior to its selection. For example, such a connector design may be employed to seal the connectors for various "options" in an automobile. At the time of selection of the sealing member, the number of options the end purchaser will select is unknown. For this reason, and also to simplify production, it is not desirable to require different sealing members based upon the number of options selected.

U.S. Pat. No. 5,588,856 entitled "Sealing Member and Methods of Sealing" issued to Collins et al and assigned to the assignee of the present invention, which is hereby incorporated by reference for all purposes, discloses a gel grommet having a layer of gel disposed between two constraining layers. The constraining layers are preferably a compressible foam which accommodates volume changes of the gel. Such gel grommets are cost-effective, re-enterable a limited number of times, enable miniaturization, and thus provide a competitive advantage in the automotive marketplace. However, particles from the material of the constraining layers may become lodged between the contacts during insertion or removal, causing interference with the connection. Additionally, the sealing material can be torn or otherwise damaged upon insertion and removal of the contacts.

U.S. Pat. No. 5,529,508 entitled "Sealing Member" issued to Chiotis et al, having a common inventor with the present invention, and commonly assigned with the present application, which is hereby incorporated by reference for all purposes, discloses a gel grommet having a layer of sealant positioned longitudinally between two constraining layers. The constraining layer is preferably a gel having a Voland hardness greater than the Voland hardness of the sealant. This configuration does not allow particles to contaminate the connection of substrates or wires inserted through the sealing member. Insertion of the substrate or wire through the sealing member may, however, tear or otherwise damage the sealing material such that it cannot be removed and reinserted without compromising seal integrity after the seal has been in use for a significant period of time.

SUMMARY OF THE INVENTION

I have developed a self supporting sealing member in which a substrate or wire can be inserted and withdrawn an unlimited number of times, without tearing or otherwise damaging the sealing material. The sealing member of the present invention also provides for lowered insertion forces, in comparison to prior art devices. This is accomplished by constructing a perforation in the sealing member with a displaceable section of sealant. The present invention also provides for contact serviceability, after initial installation of the sealing member.

One aspect of this invention comprises an assembly for sealing an open end of a hollow member having an inner surface, the assembly comprising:

a) a self supporting sealing member which comprises a layer of sealant positioned between two constraining layers and positioned such that the sealant layer and the constraining layers extend transversely across the open end of the hollow member, at least one formed in the sealing member, said perforation forming a displaceable section of sealant; and b) a force applying member to move the constraining layers and the layer of sealant into sealing contact with the inner surface of the hollow member.

Another aspect of the invention comprises a preformed sealing member comprising a self supporting member having at least one layer of sealant positioned between two constraining layers, wherein the sealing member includes at least one perforation, the perforation forming a displaceable section of sealant.

A further aspect of the invention comprises a method of sealing a substrate comprising the steps of:

a) providing an assembly comprising: a self supporting sealing member which comprises a layer of sealant positioned between two constraining layers and positioned such that the sealant layer and the constraining layers extend transversely across the open end of the hollow member, at least one perforation formed in the sealing member, said perforation forming a displaceable section of sealant; and b) inserting a substrate through the self supporting sealing member;

c) displacing said displaceable section of sealant;

d) after the step of inserting the substrate, compressing the sealing member to move the constraining layers and the layer of sealant into sealing contact with the inner surface of the hollow member.

DETAILED DESCRIPTION OF THE PREFERRED EMBODIMENTS

Figure 1:
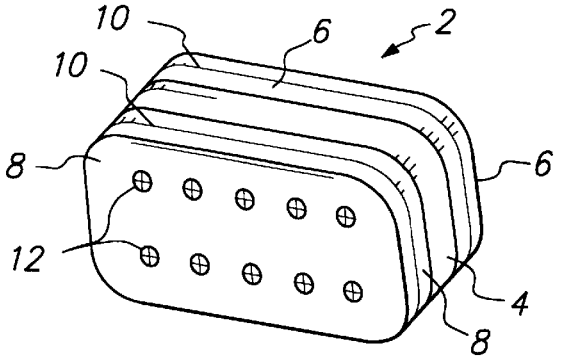
FIG. 1 illustrates a perspective view of a sealing member in accordance with the present invention.

In accordance with the preferred embodiment of the present invention, the open end of a hollow member or connector is sealed using a sealing member comprising a layer of sealant between two constraining layers. Preferably the sealing member comprises, and may consist essentially of, a sandwich structure including one layer of sealant positioned between two constraining layers. The sealing member can also comprise three or more constraining layers and two or more layers of sealant, with a layer of sealant between each adjacent pair of constraining layers. In use, the sealing member in the illustrated embodiment is placed so that it is within the hollow member and extends transversely across its open end. Once the substrates or wires are inserted, force is applied to the layers to compress the sealing member and maintain the sealant in sealing contact with the inner surface of the hollow member. The present invention may also be employed to seal an interface in which no substrates are inserted through the sealing member.

The hollow member can be, for example, a plug or cap, a pipe, an electrical housing, such as a-connector body, or the like. The invention is particularly useful to seal the opening of a multiconductor connector body, as described more fully below.

Each constraining layer is generally a plate or disk of approximately the same dimensions and configuration as the hollow member with which it is to be used, sized to fit within an open end of the hollow member. The constraining layers serve to constrain the sealant from moving or being undesirably displaced from the sealant layer, for example when a substrate or wire is inserted through the sealant layer into the hollow member. The constraining layers also permit ease of handling and manipulation of the sealing member.

The constraining layers may be the same or different. The constraining layers may be made from a material having a Voland hardness greater than the Voland hardness of the layer of sealant. Such a constraining layer may be made from a hard gel, alone, or a hard gel including a reinforcing sheet. The reinforcing sheet, if employed, serves to improve the mechanical properties, such as tensile strength and modulus of elasticity and may be a film or a matrix of, for example, foam or fabric. A fabric matrix may be a single layer or a plurality of layers. Alternatively, the constraining layer or layers may be a compressible foam, a plastic or other material.

In the most preferred embodiment, each of the constraining layers is constructed of a gel having a Voland hardness greater than the Voland hardness of the sealant. The constraining layers may be the same or different and may be a hard gel alone, or may include a reinforcing sheet such as a matrix of fabric or other material, as discussed above. A hard gel is defined herein as a gel having a Voland hardness of between 75 and 350 g. The hard gel preferably has tack of between about 0 and 15 g, and most preferably about 1 g and stress relaxation of between about 1% and 20%, and most preferably about 10%. The hard gel may be as described in U.S. Pat. No. 5,529,508 to Chiotis et al, which has been incorporated herein by reference, above.

The sealing member can be prepared by placing a constraining layer on each side of a layer of sealant. A constraining layer including a reinforcing sheet is constructed by immersing the sheet into a bath of liquid raw materials and then curing, thereby resulting in a hard gel which is reinforced by a sheet.

Figure 3:
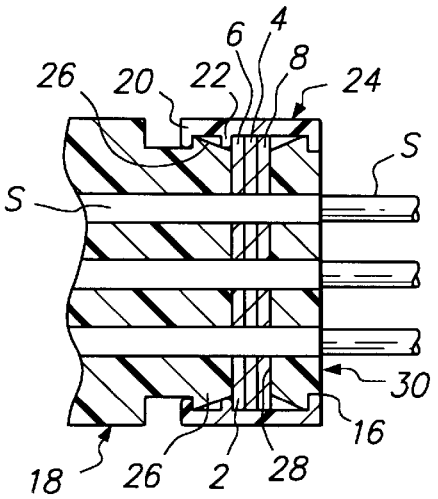
FIG. 3 is a cross-sectional view of the article in one form of connector in its first position.

The layer of sealant may be any sealing material; however, the preferred sealant is a gel. The gel preferably has a Voland hardness of about 1 to about 125 g, more preferably about 5 to about 25 g, and most preferably about 6 to about 20 g, and has an ultimate elongation of at least about 50%, preferably at least about 100%, more preferably at least about 400%, and particularly at least about 1500%. The elongation is measured according to the procedures of ASTM D217. The Voland hardness, stress relaxation and tack are measured using a Voland-Stevens Texture analyzer Model LFRA having a 1000 g load cell, a 5 gram trigger, and a ¼ inch (6.35 mm) ball probe, as described in U.S. Pat. No. 5,079,300 to Dubrow et al, the disclosure of which is incorporated herein by reference for all purposes. For measuring the hardness of a gel a 20 ml glass scintillating vial containing 10 g of gel is placed in the Voland-Stevens Texture analyzer and the stainless steel ball probe is forced into the gel at a speed of 2.0 mm a second to a penetration distance of 4.0 mm. The Voland hardness value of the gel is the force in grams required to force the ball probe at that speed to penetrate or deform the surface of the gel the specified 4.0 mm. The Voland hardness of a particular gel may be directly correlated to the ASTM D217 cone penetration hardness and the procedure and a correlation as shown in FIG. 3 of U.S. Pat. No. 4,852,646 to Dittmer et al, the disclosure of which is incorporated herein by reference for all purposes.

The gel sealant is preferably a fluid-extended polymer composition. The polymeric component can be for example, a silicone, polyorgano siloxane, polyurethane, polyurea, styrene-butadiene, styrene-isoprene, styrene-ethylene propylene-styrene, and/or styrene-ethylene butylene-styrene block copolymers. The gels may be formed from a mixture of such polymers. The layer of gel may comprise a foam impregnated with the gel. Examples of gels can be found in U.S. Pat. No. 4,600,261 to Debbaut; U.S. Pat. No. 4,690,831 to Uken et al; U.S. Pat. No. 4,716,183 to Gamarra et al; U.S. Pat. No. 4,777,063 to Dubrow et al; U.S. Pat. No. 4,864,725 to Debbaut et al; and U.S. Pat. No. 4,865,905 to Debbaut et al; and International published patent applications Nos. 86/01634 to Toy et al, and WO 88/00603 to Francis et al. The gel may be impregnated in a reinforcing sheet such as a film or a matrix such as a foam or fabric. Gel impregnated in a matrix is disclosed in U.S. Pat. No. 4,865,905 to Uken. The entire disclosures of all of the above are incorporated herein by reference for all purposes.

In a preferred embodiment, the sealing member is preformed and is a self supporting member comprising a layer of sealant positioned between two constraining layers. A self supporting sealing member is one which does not require external structural support to maintain its configuration.

The sealing member is pre-cut with at least one perforation formed in the sealing member for providing entry/exit sites for the substrates at the location at which the substrate is to be inserted. The number of perforations generally is equal to the greatest possible number of substrates to be inserted into the hollow member through the sealing member. Each perforation is such that a displaceable section of sealant is formed by the perforation, preferably in the form of an hourglass configuration. The hourglass configuration may be a single hourglass form or it may be a biconical configuration, in which two complementary conical shapes have their coneshaped ends in facing relationship with each other. Other configurations, including a cylindrical configuration, can also be employed. The displaceable section of sealant requires an insertion force which is substantially less than the insertion force required to insert the substrate or wire in prior art devices.

The hourglass configuration provides significant advantages over the prior art devices and over a cylindrical configuration. The hourglass configuration provides superior overall seal integrity when burst pressure of the system is measured. Burst pressure is defined as the pressure at which the first air bubble will appear in a water container in which the hollow member, e.g., the connector, is immersed, when internal pressure on the hollow member is increased gradually. In the present invention, burst pressure is typically measured as being superior to 3 Bars. When a substrate or wire is removed from the sealing member, the hourglass configuration allows the sealant to close on the perforation, thereby re-sealing the perforation. Additionally, an hourglass configuration can be manufactured in a more practical and economical way. This occurs because of lateral gel movements during stamping with a progressive die.

Figure 4:
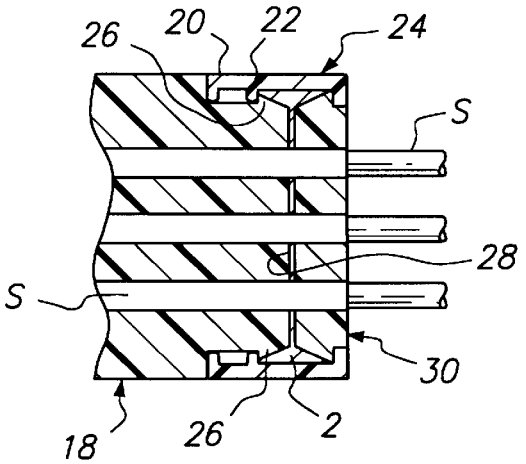
FIG. 4 is a cross-section view of the article in the connector shown in FIG. 3 in its second position.

The connector includes a force applying member for moving the layer of sealant into sealing contact with the inner surface of the hollow member. The force applying member may be constructed in any known form. The force applying member preferably includes a body member, such as a flange, employed in connection with a two-position latch mechanism. The first position of the latch mechanism maintains the body member in position with respect to the sealing member, as seen in FIG. 3, while the second position compresses the layers of the sealing member to maintain the sealant in sealing contact with the inner surface of the hollow member, as seen in FIG. 4. The most preferred arrangement of latch mechanism is in the form of a pair of lips formed on the inner surface of the hollow member which engage the body member or flange. While the flange is latched in the first position, the substrates are inserted through the sealing member, displacing a section of sealant. The flange is then moved to the second latch position such that the sealing member is compressed and the sealant is maintained in sealing contact with the inner surface of the hollow member.

Referring now to the Figures, FIG. 1 illustrates a self supporting sealing member 2 having a layer of gel sealant 4 positioned between two layers of constraining material 6, 8. In the preferred embodiment, constraining layers 6, 8, are constructed of a hard gel including a reinforcing sheet 10. The hard gel need not be reinforced.

Figure 2A:
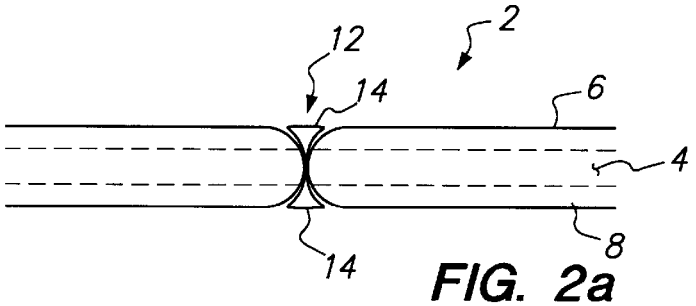
FIG. 2*a* is a schematic view of the sealing member including a perforation constructed according to the invention.
Figure 2B:
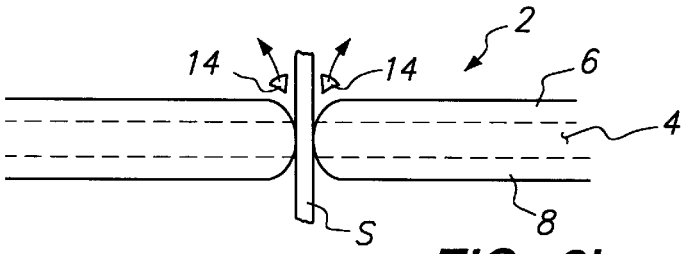
FIG. 2*b* is a schematic view of the sealing member with a substrate inserted into the sealing member.

As seen in FIGS. 2*a* and 2*b*, at least one perforation 12 is formed in sealing member 2. Displaceable sections of sealant 14 are formed by perforation 12. These sections of sealant are displaced when a substrate S is inserted into the perforation. The size of the perforation should be smaller than the substrate to be inserted therethrough so that the sealant will effectively seal around the substrates. I have found that for substrates of between 0.6 mm and 1.5 mm, the perforation is most preferably between 1.8 mm and 2.0 mm at its largest diameter.

As seen in FIGS. 3 and 4, sealing member 2 is positioned in an open end 16 of connector 18. A latch mechanism includes first and second lips 20, 22 on connector body 24 for engaging flange 26 on connector 18. First lip 20 maintains flange 26 in a first position such that sealing member 2 is maintained in a non-compressed state, as seen in FIG. 3. Flange 26 can be moved to engage second lip 22 in a second position such that the sealing member is maintained in a compressed state, as seen in FIG. 4. The latch mechanism, including first and second lips 20, 22 and flange 26 apply force to move layer of sealant 4 into sealing contact with the inner surface 28 of connector base 30.

In use, sealing member 2 is placed across open end 16 of connector 18 to be sealed, with sealant layer 4 and constraining layers 6, 8, being positioned transversely across the open end of the connector. The latch mechanism of the connector is in its first position, with flange 26 engaged by first lip 20 such that the sealing member is in a non-compressed state, as seen in FIG. 3. Substrate S is then inserted through sealing member 2 at a perforation 12. As the substrate is inserted through the perforation, displaceable section of sealant 14 is dislocated to form a passageway for the substrate, as seen in FIG. 2*b*. The insertion force required for inserting the substrate through the sealing member and to displace the displaceable section of sealant is preferably between 0 and 7.0 Newtons, more preferably between 3.0 and 5.0 Newtons. Subsequent insertions require a lower average insertion force. Force is then applied by moving the latch mechanism to its second position in which flange 26 is engaged by second lip 22, thereby compressing sealing member 2 to move the constraining layers and the layer of sealant into sealing contact with the inner surface 28, as seen in FIG. 4. It is noted that the force can be applied prior to insertion of the substrate; however, this will counterbalance some of the benefits of providing for a lowered insertion force.

If the substrate is removed from the perforation, the sealant will move together to close the perforation and re-seal the empty cavity left by the displaced section of sealant.

This is particularly advantageous in achieving contact serviceability. Contact serviceability occurs when the substrate or contact must be removed and/or replaced after installation and use for a significant period of time. For example, in an automobile, it may be necessary or desirable to replace contacts or insert additional contacts many years after a vehicle's manufacture. In many types of sealing devices, the sealing member must also be replaced. However, upon withdrawal and/or insertion of the substrate into the sealing member of the present invention, the sealant will still provide an effective seal on insertion, even without releasing the force applied by the latch mechanism prior to insertion of a substrate.

Variations and modifications can be made to the preferred embodiment without departing from the scope of the present invention, which is limited only by the following claims.

What is claimed is:

1. An assembly for sealing an open end of a hollow member having an inner surface, the assembly comprising:

a) a self supporting sealing member which comprises a layer of sealant positioned between two constraining layers and positioned such that the sealant layer and the constraining layers extend transversely across the open end of the hollow member, at least one perforation formed in the sealing member, said perforation forming a removable section of sealant; and b) a force applying member to move the constraining layers and the layer of sealant into sealing contact with the inner surface of the hollow member.

2. The assembly as defined in claim 1 wherein the perforation has an hourglass configuration.

3. The assembly as defined in claim 1 wherein the constraining layers each comprise a gel having a Voland hardness greater than the Voland hardness of the sealant layer.

4. The assembly as defined in claim 1 wherein the constraining layers each comprise a compressible foam.

5. The assembly as defined in claim 1 wherein the layer of sealant includes a reinforcing sheet.

6. The assembly as defined in claim 5 wherein the reinforcing sheet comprises a matrix.

7. The assembly as defined in claim 6 wherein the matrix comprises at least one layer of fabric.

8. The assembly as defined in claim 6 wherein said matrix comprises a plurality of layers of fabric.

9. A preformed sealing member comprising a self supporting member having at least one layer of sealant positioned between two constraining layers, wherein the sealing member includes at least one perforation, the perforation forming a removable section of sealant.

10. The assembly as defined in claim 9 wherein the perforation has an hourglass configuration.

11. The assembly as defined in claim 9 further comprises a force applying member to move the constraining layers and the layer of sealant into sealing contact with the inner surface of the hollow member.

12. A method of sealing a substrate comprising the steps of:

a) providing an assembly comprising:

a self supporting sealing member which comprises a layer of sealant positioned between two constraining layers and positioned such that the sealant layer and the constraining layers extend transversely across the open end of the hollow member, at least one perforation formed in the sealing member, said perforation formation a removable section of sealant; and b) inserting a substrate through the self supporting sealing member;

c) displacing said removable section of sealant;

d) after the step of inserting the substrate, compressing the sealing member to move the constraining layers and the layer of sealant into sealing contact with the inner surface of the hollow member.

13. The method as defined in claim 12 wherein the assembly is re-enterable for sealing a substrate an unlimited number of times.

14. The method as defined in claim 12 wherein the step of providing an assembly comprises providing a self supporting sealing member including at least one perforation having an hourglass configuration.

15. The method as defined in claim 12 wherein the insertion force required for inserting the substrate is between 3 and 5 Newtons.

* * * * *